US009932772B2

(12) United States Patent
Kirkhope

(10) Patent No.: US 9,932,772 B2
(45) Date of Patent: Apr. 3, 2018

(54) SYSTEMS AND METHODS FOR LIMITING TORQUE TRANSMISSION

(75) Inventor: Kennedy John Kirkhope, Leduc (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 250 days.

(21) Appl. No.: 14/344,634

(22) PCT Filed: Sep. 20, 2011

(86) PCT No.: PCT/US2011/052281
§ 371 (c)(1),
(2), (4) Date: Mar. 13, 2014

(87) PCT Pub. No.: WO2013/043153
PCT Pub. Date: Mar. 28, 2013

(65) Prior Publication Data

US 2014/0338980 A1 Nov. 20, 2014

(51) Int. Cl.
*E21B 4/00* (2006.01)
*E21B 44/04* (2006.01)
*E21B 7/00* (2006.01)

(52) U.S. Cl.
CPC ..... *E21B 4/006* (2013.01); *E21B 7/00* (2013.01); *E21B 44/04* (2013.01)

(58) Field of Classification Search
CPC ..... E21B 7/00; E21B 44/04; E21B 4/006
See application file for complete search history.

(56) References Cited

U.S. PATENT DOCUMENTS

| | | | |
|---|---|---|---|
| 2,028,407 | A | 1/1936 | Moineau |
| 3,232,362 | A | 2/1966 | Cullen |
| 3,572,771 | A | 3/1971 | Redwine |
| 3,600,113 | A | 8/1971 | Pahl |
| 3,840,080 | A | 10/1974 | Berryman |
| 3,939,670 | A | 2/1976 | Amtsberg |
| 4,339,007 | A | 7/1982 | Clark |
| 4,768,598 | A | 9/1988 | Reinhardt |

(Continued)

FOREIGN PATENT DOCUMENTS

| | | |
|---|---|---|
| EP | 0069530 A2 | 1/1983 |
| EP | 0400921 A2 | 12/1990 |

(Continued)

OTHER PUBLICATIONS

International Search Report and the Written Opinion of the International Searching Authority, or the Declaration, dated Feb. 9, 2012, 12 pages, International Searching Authority, U.S.

(Continued)

*Primary Examiner* — Giovanna C. Wright
*Assistant Examiner* — Manuel C Portocarrero

(57) ABSTRACT

A drill string for drilling a subterranean wellbore includes a shaft connectable to a first drill string portion and a housing connectable to a second drill string portion. A torque relief section is disposed between the shaft and housing. The torque relief section includes a slip section operable to slip and release torque buildup when torque applied between the shaft and housing exceeds a threshold torque. The threshold torque of the torque relief section is selected to be within the range of about 110% and 150% of the operating torque and below the peak operating torque for the drill string.

20 Claims, 4 Drawing Sheets

(56) References Cited

U.S. PATENT DOCUMENTS

| | | | | |
|---|---|---|---|---|
| 5,002,517 | A | 3/1991 | Heidenreich et al. | |
| 5,090,497 | A | 2/1992 | Beimgraben | |
| 5,135,059 | A | 8/1992 | Turner | |
| 5,323,852 | A | 6/1994 | Cornette | |
| 5,738,178 | A | 4/1998 | Williams | |
| 5,775,444 | A | 7/1998 | Falgout, Sr. | |
| 6,305,723 | B1 * | 10/2001 | Schutz | E21B 17/042 285/333 |
| 6,594,881 | B2 | 7/2003 | Tibbitts | |
| 7,757,781 | B2 | 7/2010 | Hay | |
| 2003/0164276 | A1 | 9/2003 | Snider | |
| 2004/0108138 | A1 | 6/2004 | Cooper | |
| 2006/0243493 | A1 | 11/2006 | El-Rayes | |

FOREIGN PATENT DOCUMENTS

| | | |
|---|---|---|
| EP | 0566144 A1 | 10/1993 |
| GB | 2466812 | 7/2010 |
| WO | WO 00/24997 | 5/2000 |

OTHER PUBLICATIONS

International Preliminary Report on Patentability, dated Nov. 22, 2013; 10 pages, International Preliminary Examining Authority, U.S.

* cited by examiner

SYSTEMS AND METHODS FOR LIMITING TORQUE TRANSMISSION

The present application is a U.S. National Stage patent application of International Patent Application No. PCT/US2011/052281, filed on Sep. 20, 2011, the benefit of which is claimed and the disclosure of which is incorporated herein by reference in its entirety.

FIELD OF THE INVENTION

The present invention relates to systems and methods for the drilling of well bores, and, more particularly, to systems and methods for limiting torque transmission in a drilling string.

BACKGROUND

In connection with the recovery of hydrocarbons from the earth, wellbores are generally drilled using a variety of different methods and equipment. According to one common method, a roller cone bit or fixed cutter bit is rotated against the subsurface formation to form the wellbore. The bit is rotated in the wellbore through the rotation of a drill string attached to the bit and/or by the rotary force imparted to the bit by a subsurface fluid motor powered by the flow of drilling fluid through the drill string.

A problem associated with normal rotary drilling of this type, particularly when a fixed bit configuration is used, is that a stall condition can result once a certain torque load threshold at the bit is reached, in which case the bit may drag or stop rotating completely. When a bit stalls, typically, the attached drill string continues to turn, which can result in damage to the drill string and/or bottom hole assembly. Even if the operating torque applied through the string eventually succeeds in breaking the bit free of the formation, i.e., overcoming the torque load on the bit resulting in a stall, the sudden release of the bit can cause it to rotate faster than the drill string, resulting in a condition referred to as stick-slip. Stick-slip can cause problems in the operation of the drilling assembly and in the formation of the well bore.

Conventional techniques to reduce the incidence of damage to the motor, drill string, bottom hole assembly or wellbore occurring as a result of high torque loads include increasing shaft sizes and utilizing enhanced or alternative materials. However, while technology has continued to develop more powerful driving systems, there are limits to the size and materials that can reasonably be used for the various components. For example, annulus dimensions limit the radial size of the components, while cost considerations may limit material choice.

Thus it would be desirable to provide a drilling system that can operate at higher torques without increasing the likelihood that a peak torque threshold will be crossed, while at the same time minimizing component dimensions and material costs.

BRIEF DESCRIPTION OF THE DRAWINGS

A more complete understanding of the present disclosure and advantages thereof may be acquired by referring to the following description taken in conjunction with the accompanying figures, wherein.

DETAILED DESCRIPTION

Figure 1:
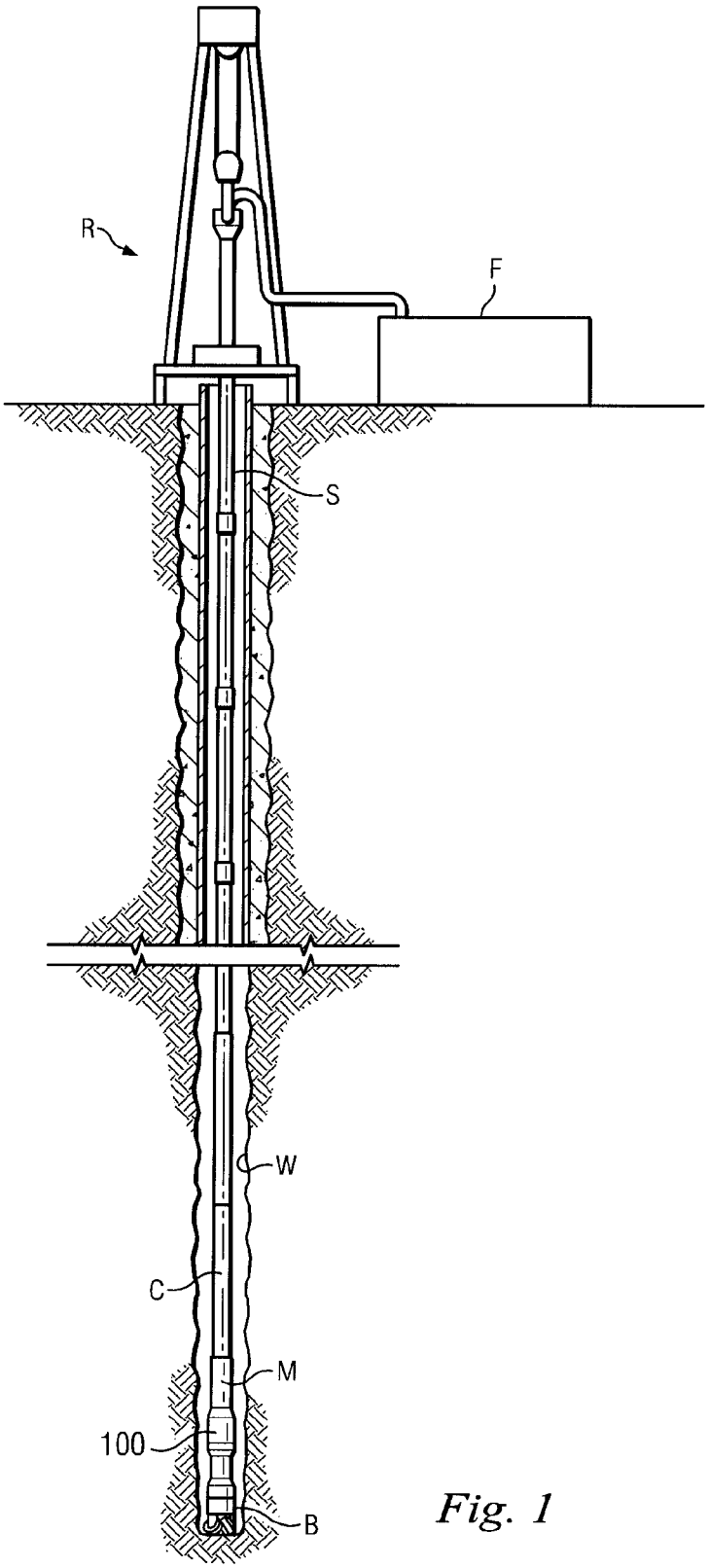
FIG. 1 is an illustration in partial cross-section of a drilling rig for drilling a well bore with the drilling system in accordance with the principles of the present invention.

In the detailed description of the embodiments, like numerals are employed to designate like parts throughout. Various items of equipment, such as pipes, valves, pumps, fasteners, fittings, etc., may be omitted to simplify the description. However, those skilled in the art will realize that such conventional equipment can be employed as desired.

The systems and methods disclosed herein are designed to limit torque transmission from a drive shaft to a torsion rod during moments of excessive torque in drilling operations. For example, while the systems, referred to herein as torque limiting systems, maintain full torque transmission during regular operating torque conditions, they are configured to slip or disengage prior to reaching peak torque, thereby diminishing the likelihood of a stall or stick slip condition. As a result of the torque limiting system of the invention, rather than providing drilling components designed to withstand peak torque, drilling components can be designed around operating torque conditions, i.e., to withstand torque levels higher than the operating torque, but still less than the peak torque. With the ability to achieve operating torques closer to the peak torque without fear of reaching peak torque, drilling systems can be designed smaller while still substantially maintaining the same overall drilling efficiency and progress. Moreover, because the components are smaller, additional space may become available within the drill string for other equipment, such as, for example, additional instrumentation, instrumentation lines, communication lines, guidance systems, among other components. Alternatively, instead of using smaller components to meet conventional drilling loads, the target operating torques can be increased, thereby providing additional drilling speed and efficiency, while still maintaining the operating torque below the peak torque.

In conventional systems, drill strings are rated to operate at a particular operating torque. The initial size, material, and design shape of components are selected to permit the system to operate at the target torque. However, in order to avoid damage and time-consuming breakdown, drill string components may then be scaled up to withstand peak torques, so as to minimize the likelihood that stall or slip-stick will occur. Peak operating torques are typically 1.5-2.5 times the operating torques. Accordingly, drill strings having a particular rated operating torque are likely to be over-designed to compensate for the peak torque, resulting in larger components or more exotic component materials. Alternatively, for the same size components, the rated operating torque may be set well below the peak torque, sacrificing a larger window for operating torque in order to maintain a cushion between any potential operating torque and the peak torque. In the invention, by disassociating the peak torque from the operating torque, the operating torque can be increased without a need to modify the drill string components or unnecessarily limit the torque applied to the drill string.

By reducing the likelihood that peak torque will occur, the components and systems of the drill string can be selected to have torque ratings closer to the peak torque without the need to over-compensate the design of the components. This ability to operate at higher torque permits increased drilling speed and increased drilling load, and hence, increased efficiency, without requiring accommodations for peak torque. It has been found that utilizing the invention as described herein, it is possible to increase the operating torque by about 30% without significantly increasing the likelihood that peak torque will be reached. Accordingly, instead of being subjected to loading that may be 1.5 to 2.5 times the operating torque limits, applied torques are limited to only the desired slip torque, which in this example, is only 30% over the operating torque.

FIG. 1 of the drawings illustrates a drill string, indicated generally by the reference letter S, extending from a conventional rotary drilling rig R and in the process of drilling a well bore W into an earth formation. The lower end portion of the drill sting S includes a drill collar C, a subsurface drilling fluid-powered motor M, and a drill bit B at the end of the string S. The bit B may be in the form of a roller cone bit or fixed cutter bit or any other type of bit known in the art. A drilling fluid supply system F circulates a drilling fluid, such as drilling mud, down through the drill string S for discharge through or near the bit B to assist in the drilling operation. The fluid then flows back to the rig R, such as by way, for example, of the annulus formed between the well bore W and the drill string S. The well bore W is drilled by rotating the drill string S, and therefore the bit B, from the rig R in a conventional manner, and/or by rotating the bit B with rotary power supplied to the subsurface motor M by the circulating fluid in a manner to be described. Since all of the above components are conventional, they will not be described in detail. Those skilled in the art will appreciate that these components are recited as illustrative for contextual purposes and not intended to limit the invention described below.

A torque limiting system 100 according to an exemplary embodiment of the present disclosure is shown below the motor M and the drill collar C for the purpose of limiting torque applied to the motor and bit from the string S to a slip torque value. In one example, the slip torque value is a selected to be between the operating torque and the peak torque. In one example, the slip torque is about 30% higher than the operation torque, although other levels between the operating torque and the peak torque are also contemplated.

Figure 2:
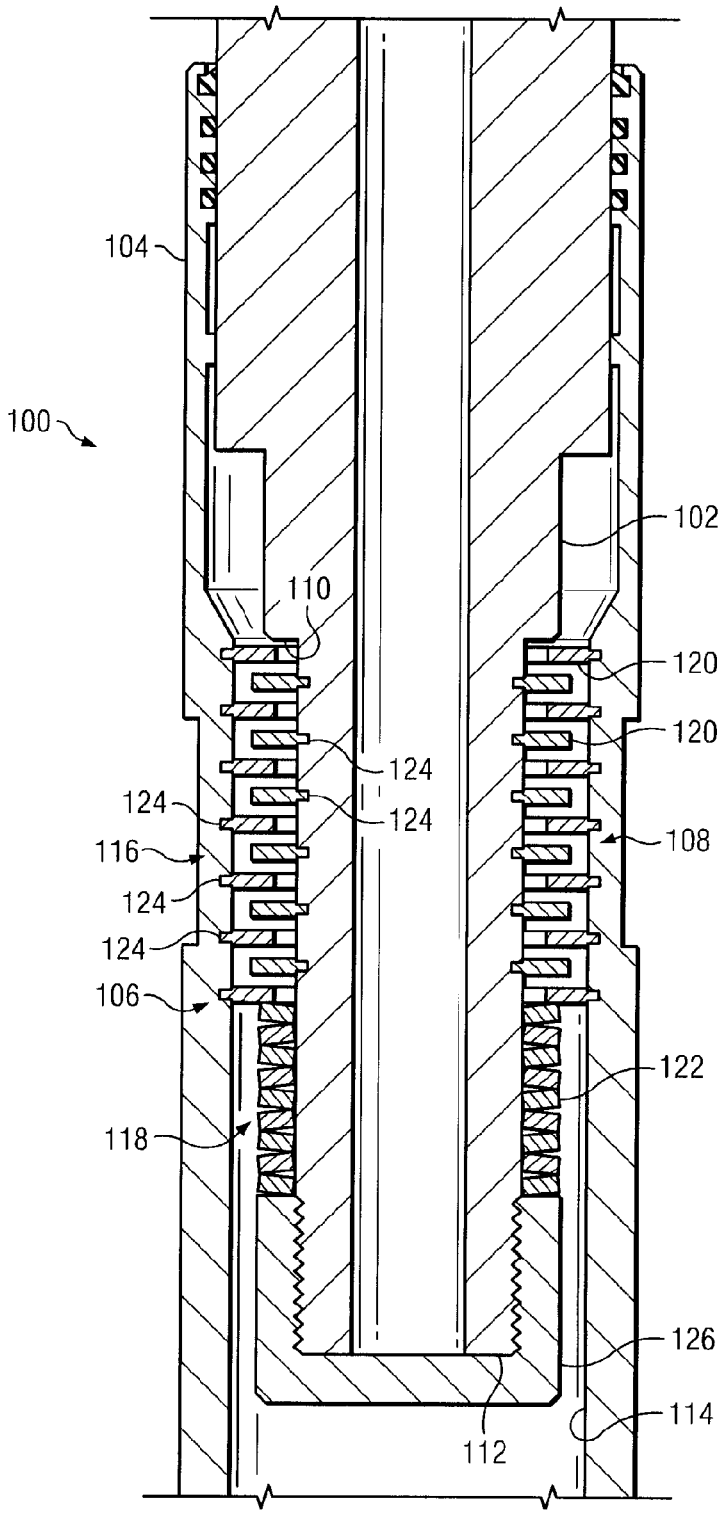
FIG. 2 is an illustration of a cross-sectional side view of an exemplary torque limiter deployable on the drilling system of FIG. 1 in accordance with the principles of the present invention.

FIG. 2 illustrates one example of a torque limiting system 100 disposed between the motor M and the bit B. Specifically, FIG. 2 shows a cross-sectional view of the torque limiting system 100, which system includes a shaft 102, an outer housing 104, and a torque relief section 106. Here, the shaft 102 connects to the uphole portion of the drill string. As such, it connects, for example, to the motor M or the drill string S. The outer housing 104, in this example, connects to the downhole portion of the drill string. As such, it may connect to the bit, a bottom hole assembly, a collar, a segment of additional drill string, or other intervening drilling component.

In the example shown, the shaft 102 includes a reduced-diameter distal end segment 108. The distal end segment 108, in this embodiment, extends from a shoulder 110 formed in the shaft 102 to a shaft end 112.

The outer housing 104 includes a bore 114 sized to receive at least the distal end segment 108. In the example shown, the bore 114 is sized to receive the outer diameter of both the distal end segment 108 and a portion of the main body of shaft 102. The outer housing 104 described herein may be the outer housing of the drill string S or may be the outer housing of the distal end segment 108 of the shaft 102.

The torque relief section 106 is configured and structurally arranged to provide sufficient rigidity under normal operating torque loads, but designed so that the shaft 102 provides controlled torque relief through a controlled slip before a peak torque load or other preselected torque threshold is reached. The torque relief section 106 frictionally engage the shaft 102 and the outer housing 104 to one another, but is characterized by a selected coefficient of friction so that the respective shaft 102 and housing 104 slip relative to one another at a desired torque threshold, providing torque relief. In one embodiment, the torque relief section 106 includes a slip section 116 and a load section 118. Slip section 116 comprises a plurality of interleaved clutch plates 120, each associated with one of the shaft 102 or the outer housing 104. The load section 118 comprises a load applicator enabling the torque relief section 106 to have a particular slip threshold. In one embodiment, the load applicator comprises one or more biasing elements, such as a coiled spring or, as illustrated, a series of disk springs 122, such as a Bellville disks.

As shown in FIG. 2, each clutch plate 120 extends normal to the axis of the shaft 102 and housing 104 and connects to either the shaft 102 or the outer housing 104. The clutch plates 120 are arranged to be interleaved with one another. Housing 104 and/or shaft 102 may each include a series of splines 124 formed therein and shaped and configured to receive the clutch plates 120.

A fastener 126, such as an end cap or bolt is disposed to engage the shaft end 112 and secure the spring 122 onto the distal end segment 108. In the illustrated embodiment, the end cap 126 includes internal threads and the distal end segment 108 includes external threads. As such, the end cap 126 may be threaded onto the shaft 102 to secure the slip section 116 and the load section 118 in place on the distal end segment 108.

In the illustrated embodiment, the disk springs 122 are compressed between and therefore apply loading against the end cap 126 and the distal-most clutch plate 120 associated with the housing 104. Accordingly, the force of the springs 122 displaces the shaft 102 and the outer housing 104 so that the clutch plates 120 are engaged and compressed against each other by the loading of the springs 122.

The clutch plates 120 may be designed and selected to provide a suitable frictional resistance to slippage under a desired load. By balancing the load section 118 and the frictional resistance in the slip section 116, relative precise control of the slip torque may be achieved. For example, the overall coefficient of friction for the torque relief section 106 may be directly determined based on the coefficient of friction in the slip section 116 and the loading applied by the load section 118. That is, the coefficient of friction for the torque relief section 106 may be selected based upon the materials of the clutch plates 120 and their frictional area, and the force applied on the clutch plates 120 by the springs 122. As such, the torque limiting system 100 may be specifically engineered to slip at a particular torque threshold. In one embodiment, the torque threshold is selected to be substantially below the peak operating torque and within the range of about 110% and 190% of the operating torque. In another embodiment, the torque threshold is selected to be within the range of about 120% and 150% of the operating torque. In yet another embodiment, the torque threshold is selected to be about 130% of the operating torque.

The clutch plates 120 may be formed of a suitable material having a known coefficient of friction. In one embodiment, the clutch plates 120 may be formed of metals or ceramics, among other materials. In another embodiment, the plates are steel plates. In another embodiment, the plates are carbides, including, for example, tungsten carbide. In other embodiments, the clutch plates are steel plates having a brass coating impregnated with friction inducing materials. Of course, those skilled in the art will appreciate that clutch plates formed of different materials may also be used, permitting additional flexibility in achieving a desired torque threshold for the system. Moreover, the clutch plate materials may be selected based on wear properties, frictional coefficients, ductility, or corrosion resistance, among other factors.

Since the overall diameter of the torque limiting system 100 is limited by drilling constraints, such as the diameter of a bore hole, the example in FIG. 2 employs a series of stacked clutch plates 120 can be summed to achieve an overall contact area suitable to resist slippage during normal operating torques. By controlling the contact area or other parameter, the desired slip torque can be achieved.

Figure 3:
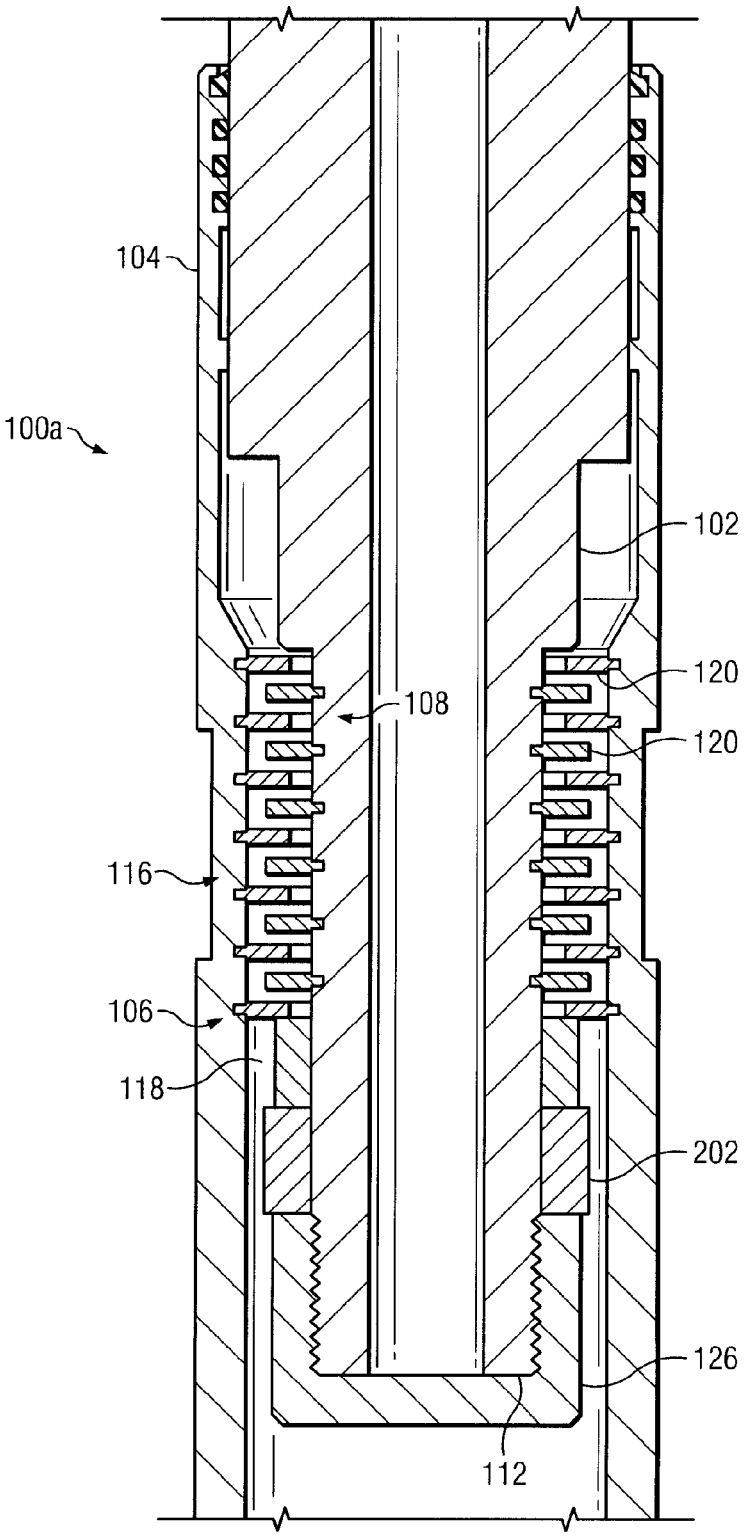
FIG. 3 is an illustration of a cross-sectional side view of an alternative embodiment of an exemplary torque limiter deployable on the drilling system of FIG. 1 in accordance with the principles of the present invention.

FIG. 3 illustrates another embodiment of the torque limiting system of the invention, referenced herein as 100*a*. Like the torque limiting system shown in and described with reference to FIG. 2, the torque limiting system 100*a* includes the shaft 102, the housing 104, and the torque relief section 106, with the slip section 116 and the load section 118. Here however, the load section 118 comprises a load applicator formed as pistons 202 in place of the springs of FIG. 2.

The pistons 202, like the disk springs, bear against fastener 126 on shaft 102 and the distal most clutch plate 120 of the housing 104, thereby engaging the clutch plates 120 on the shaft 102 and housing 104. The pistons 202 may be selected to apply the loading required to, along with the interface area and material of the clutch plates, achieve a desired resistance to slippage. In one embodiment, the pistons are hydraulic pistons. These may be controlled to provide a desired loading based on the drilling occurring. For example, the pistons may be selected or controlled based on the specifications and the drilling plan for the drill string. In one example, the pistons are controlled based on drill bit type, geological type, or depth of drilling. In one embodiment, the hydraulic pistons can be adjusted on the fly or in real time to permit torque thresholds to be altered as drilling conditions change during the drilling process.

Although FIGS. 2 and 3 respectively show the load applicator of the load section 118 with disk springs and pistons, respectively, other embodiments include yet other load applicators. For example, in some embodiments, the load applicators are elastomeric, coil springs, or other spring types or mechanisms capable of applying loading.

Figure 4A:
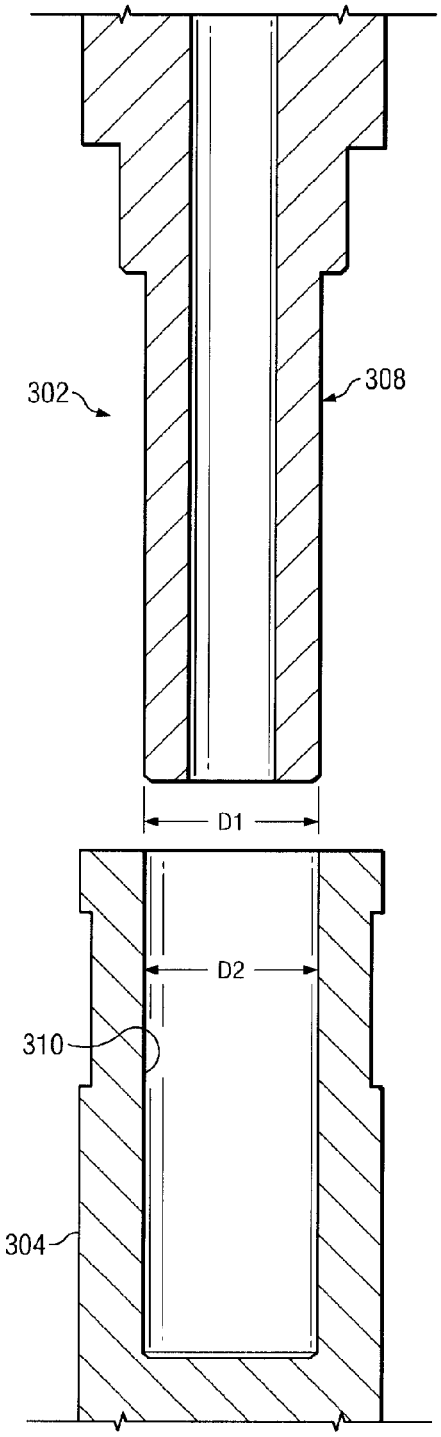
FIGS. 4A and 4B are illustrations of cross-sectional side views of an alternative embodiment of an exemplary torque limiter deployable on the drilling system of FIG. 1 in accordance with the principles of the present invention.
Figure 4B:
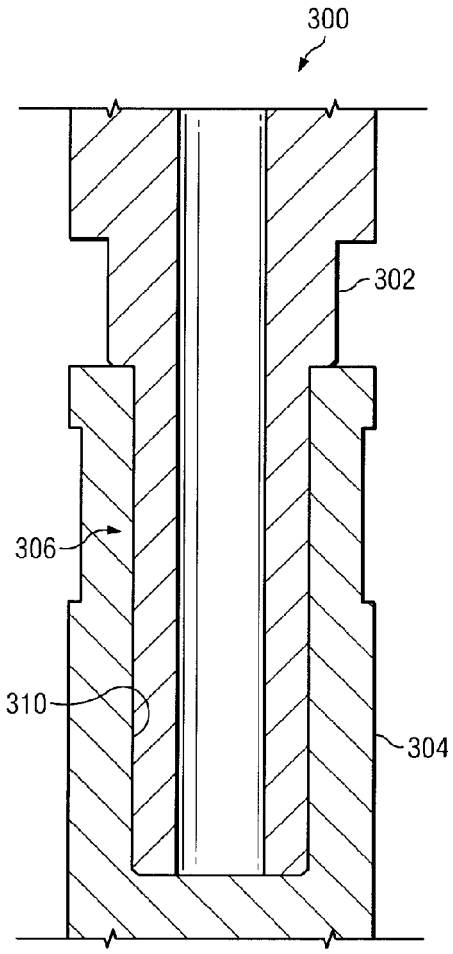

FIGS. 4A and 4B shows another example of a torque limiting system, referenced herein by the numeral 300. The torque limiting system 300 operates in a manner similar to that described above. However, instead of slipping at a desired torque threshold using clutch plates 120, the example in FIG. 4 slips at a desired torque threshold using friction between the shaft and housing themselves.

Turning now to FIGS. 4A, 4B, the torque limiting system 300 includes a shaft 302 and a housing 304. The shaft 302 connects to the uphole portion of drill string S and the housing 304 connects to the downhole portion of drill string S, although these could be switched in this or any embodiment disclosed herein. The system 300 includes a torque relief section 306. In this embodiment, the torque relief section 306 comprises a slip section defined by the contact area of the shaft 302 and the housing 304. While the examples above operate by applying axial loading to generate slip limits or to achieve the desired slip threshold, the example in FIGS. 4A, 4B applies radial loading to generate slip limits to achieve the desired slip threshold.

As can be seen in FIG. 4A, the shaft 302 includes a distal end segment 308 and the housing includes a bore 310 formed therein. The distal end segment 308 fits within the bore 310 using an interference fit. Accordingly, the exterior surface of the distal end segment 308 and the interior surface of the bore 310 cooperate to form the slip section of the torque relief section 306. Because of the interference fit, instead of applying slip loading in the axial direction, as do the transverse clutch plates 120, the embodiment in FIGS. 4A and 4B applies loading in a radial direction.

In one embodiment, the interfacing materials of the shaft 302 and housing 304 comprise dissimilar materials to avoid friction welding, which may not slip at the desired threshold. Further, the materials may be selected for their compatibility or low propensity for galling. As an example, shaft 302 may be formed of a standard steel material and the housing 304 may formed of titanium. Other material combinations are contemplated with the understanding that the design and the materials are selected to achieve a slip at a desired threshold.

Like the embodiments above, the frictional properties of the torque limiting system 300 are precisely controlled to provide a slip threshold above the operating torque but well below the peak torque. Accordingly, the materials and the interference are selected in order to achieve the desired slip threshold.

The torque limiting systems disclosed herein are particularly designed to slip at applied torques less than the peak torques to enable the drill strings and drilling components to be used in environments or under conditions in which they could not be used before. As such, the system of the invention permits the use of smaller components or alternatively an increase in operating torques for a particular system.

To implement the principles and systems herein described to achieve desirable benefits, designers may first estimate an initial operating torque for a particular drill string identified for an initial drilling plan. The initial operating torque may be estimated using formulas, models, guidelines, and standards known to designers or those of ordinary skill in the industry. The designers then estimate a conventional peak torque based on the conventional formulas, models, guidelines, and standards. With these values, the designers can then design or select a torque limiting system having an estimated threshold value or slip torque value that is greater than the estimated operating torque value and less than the estimated peak operating torque value. The torque limiting system can be designed or selected based on factors including the exemplary factors discussed above, including, for example, size and frictional areas, materials, coefficients of friction, material compatibility, wear properties, ductility, size constraints, and others. In some examples, the torque limiting system may be designed with a slip torque value substantially below the estimated peak torque and within the range of about 110% and 190% of the estimated operating torque. In other examples, the torque threshold is selected to be within the range of about 120% and 150% of the estimated operating torque. In yet other examples, the torque threshold is selected to be about 130% of the estimated operating torque. In some examples, the torque limiting system is one of the systems described above.

With the torque limiting system selected and with a slip torque threshold known, the designers can then make adjustments to the initial drilling plan, such as for example, downsizing the size of one or more components of the drill string or increasing the power to be used in the drilling plan. Since the drill string down hole from the torque will be subject only to the slip torque, but not subject to the peak torque, the designers may utilize components down hole from the torque limiting system that have a torque rating less than the peak torque. In one example, the designers may utilize a bottom hole assembly down hole of the torque limiting system, where the bottom hole assembly has a rated torque limit lower than the peak operating torque, but above the slip torque.

As described, therefore, a method for drilling a wellbore is contemplated wherein a drill string is characterized by a first portion and a second portion and the two portions are joined together by a torque limiting mechanism. An operating torque is applied to the first portion of the drill string. As long as the operating torque is below a predetermined torque slip threshold, the torque limiting mechanism transfers the operating torque from the first portion of the drill string to the second portion of the drill string. In the event that the operating torque exceeds the torques slip threshold, the torque limiting mechanism disengages the first and second portions of the drill string. Following disengagement, the operating torque of the first portion of the drill string may then be lowered until the torque limiting mechanism re-engages the first and second portions of the drill string, at which point drilling can continue.

Accordingly, the present disclosure enables the sizes of components or overall systems to be reduced while still substantially maintaining the same overall drilling efficiency and progress, providing additional space within the drill string for additional components. It also may permit devices to be used in higher powered applications, with higher drilling speeds and efficiencies, while still maintaining the applied torque below the peak torques that occur during stall or stick slip conditions.

It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

I claim:

1. A drill string for drilling a subterranean wellbore, comprising:
- a shaft connectable to a mud motor, the shaft having a central longitudinal axis;
- a housing connectable to a drill bit; and
- a torque relief mechanism joining the shaft and housing, the torque relief mechanism comprising:
  - a slip mechanism comprising a series of stacked, interleaved clutch plates alternatingly secured to the housing and the shaft, and operable to slip and release torque buildup when torque applied between the shaft and housing exceeds a threshold torque; and
  - a load mechanism operable to engage the shaft and the housing;
  - wherein the load mechanism is compressed between an end structure disposed at a distal end of the shaft and a clutch plate associated with the housing.

2. The drill string of claim 1, wherein the load mechanism radially loads the slip mechanism.

3. The drill string of claim 1, wherein the load mechanism axially loads the slip mechanism.

4. The drill string of claim 3, wherein the load section comprises at least one of a disk spring, a piston, a coil spring, and an elastomeric element.

5. The drill string of claim 1, wherein the end structure is further disposed to urge the load mechanism against the torque relief mechanism.

6. The drill string of claim 1, wherein the housing and the shaft each comprise a series of splines, the clutch plates being disposed within the splines.

7. The drill string of claim 6, wherein the splines are disposed in an inner bore surface of the housing and in an outer bore cylindrical surface of the shaft.

8. The drill string of claim 1, wherein the torque limiting device has a slip torque threshold within about 110 to 150% of the desired operating torque.

9. A drill string for drilling a subterranean wellbore, comprising:
- a shaft connectable to a mud motor, the shaft having a central longitudinal axis;
- a housing connectable to a drill bit; and
- a torque relief mechanism disposed between the mud motor and the drill bit, the torque relief mechanism comprising:
  - a first plurality of clutch plates secured to an inner bore surface of the housing; and
  - a second plurality of clutch plates secured to an outer cylindrical surface of the shaft,
  - a load mechanism positioned between an end structure disposed at a distal end of the shaft and the first plurality of clutch plates that compresses the first and second plurality of clutch plates against one another.

10. The drill string of claim 9, wherein the load mechanism comprises at least one piston applying a compressive force on the first and second plurality of clutch plates.

11. The drill string of claim 10, wherein the piston is hydraulically operable and adjustable during drilling to alter the compressive force applied to the first and second plurality of clutch plates.

12. The drill string of claim 9, wherein the first plurality of clutch plates are interleaved with the second plurality of clutch plates.

13. The drill string of claim 9, wherein the housing and the shaft each comprise a series of splines, the clutch plates being disposed within the splines.

14. The drill string of claim 9, wherein the load section comprises a plurality of disk springs applying the force compressing the clutch plates.

15. The drill string of claim 9, wherein the load mechanism is compressed between an end structure and a clutch plate associated with the housing.

16. The drill string of claim 9, wherein the torque limiting device has a slip torque threshold within about 110 to 150% of the desired operating torque.

17. A method for drilling a wellbore, said method comprising:
- determining a desired operating torque for a drill string having a mud motor and a drill bit;
- determining a peak torque for the mud motor;
- selecting a torque slip threshold between the desired operating torque and the peak torque; and
- fitting the drill string with a torque limiting device between the mud motor and the drill bit, the torque limiting device having a first plurality of clutch plates and second plurality of clutch plates, each clutch plate connecting to either the mud motor or the drill bit, the torque limiting device configured to slip at the torque slip threshold selected to be higher than the operating torque and less than the peak torque.

18. The method of claim 17, wherein the method further comprises: applying an actual operating torque to the mud motor of the drill string; utilizing said torque limiting mechanism to transfer the actual operating torque from the mud motor of the drill string to the drill bit of the drill string as long as the actual operating torque is below a predetermined torque slip threshold, and utilizing the torque limiting mechanism to disengage the mud motor and drill bit of the drill string when the operating torque exceeds the torque slip threshold.

19. The method of claim 17, wherein fitting a drill string with a torque limiting device comprises providing a torque limiting device having a slip torque threshold within about 110 to 150% of the desired operating torque.

20. The method of claim 19, wherein providing a torque limiting device includes providing a torque limiting device a having a slip torque threshold of about 130% of the desired operating torque.

* * * * *